US005271481A

United States Patent [19]

Rich

[11] Patent Number: 5,271,481

[45] Date of Patent: Dec. 21, 1993

[54] ROLLING RESTRAINT DEVICE

[76] Inventor: Timothy Rich, 45 Bridge Ct., Etters, Pa. 17319

[21] Appl. No.: 797,124

[22] Filed: Nov. 20, 1991

[51] Int. Cl.[5] ..... A62B 35/00

[52] U.S. Cl. ..... 182/3; 182/36; 248/228

[58] Field of Search ..... 182/3-9, 182/36; 248/228, 499

[56] References Cited

U.S. PATENT DOCUMENTS

| | | | |
|---|---|---|---|
| 1,054,376 | 2/1913 | Weidrich | 182/36 X |
| 2,761,396 | 9/1956 | Harlan | 182/36 |
| 4,592,686 | 6/1986 | Andrews | 248/489 |
| 4,606,430 | 8/1986 | Roby et al. | 182/3 |
| 4,767,091 | 8/1988 | Cany | 182/3 X |

*Primary Examiner*—Alvin C. Chin-Shue

*Attorney, Agent, or Firm*—Woodcock Washburn Kurtz Mackiewicz & Norris

[57] ABSTRACT

An improved rolling restraint device and method for restraining a person are disclosed. In a preferred embodiment, a lockable hinged frame that has a roller which is adapted for rolling on a surface of a structure is provided. Preferably, the structure to which the rolling restraint device is attached is a railroad rail. In certain embodiments, side rollers are also provided that permit the apparatus to continue to roll even in a tipped or tilted configuration. A tether is attached to an attachment point that is preferably disposed on top of the frame that surrounds the rolling restraint device. The tether is also attached to the person being restrained and thereby provides a safety device which may be moved along as the person moves along the track or work place.

15 Claims, 2 Drawing Sheets

ROLLING RESTRAINT DEVICE

The present invention relates to safety apparatus and, more particularly, the present invention relates to apparatus for restraining personnel after falling from a bridge or similar structure.

BACKGROUND OF THE INVENTION

There are many types of structures, for example bridges and viaducts that carry a road surface such as a railway or highway at a height sufficient to be dangerous should a person working on such a structure fall. Since it is inevitable that such structures will require maintenance, repair or modification, it is likewise inevitable that certain personnel will be exposed to this danger. In order to minimize the danger, both the Occupational Safety and Health Administration (OSHA) and the Federal Railroad Association (FRA) have introduced regulations to help ensure the safety of these personnel. Typically, scaffolding or nets are required to be placed along the sides of a bridge or other structure. However, such scaffolding or nets are relatively expensive, particularly in instances of short term repair work or inspection.

In the instance of railway bridges or other structures, it has been suggested that personnel can be tethered to a rail. In the event of a mishap, the tether would safely suspend a person from the rail and permit rescue. Thus, the restraint device connecting the tether to the rail must be strong enough to withstand the shock loads created by a falling person and remain affixed to the rail. As a result, such a restraint device is quite heavy. In order to increase the mobility of the person working on the structure restraint devices having sets of upper and lower rollers to permit the restraint device to be moved along the rail. Such designs are unwieldy, however, since it is a relatively complicated procedure to assemble the rollers and restraint device to the rail. Finally, the known designs suffer from the further drawback of having two sets of vertically spaced-apart rollers, which limit the use of a restraint device to rails of certain maximum rail head or minimum height dimensions.

It would therefore be desirable to provide an improved restraint device to tether a person to a rail. Accordingly, it is an object of the present invention to provide a restraint device that is easily engaged with and removed from a rail that is designed to enhance the mobility of the tethered person. It is a further object of the present invention to provide a rolling restraint device which is readily adapted to rails of almost any size.

SUMMARY OF THE INVENTION

Accordingly, it has now been found that an improved apparatus for creating a rolling restraint point connected to a structure can be provided which comprises a frame that has a top portion and two side portions that engage the structure, wherein at least one of the side portions is provided with a lockable hinge. Preferably, there is at least one roller disposed beneath the top portion of the frame such that it rolls upon a surface of the structure. Finally, a restraint point for connecting a tether is also provided and is preferably attached to the top of the frame. In preferred embodiments the side portions are comprised of upper and lower portions that are connected by a hinge pin and a hinge lock pin that engage each of the upper and lower portions. Also, in certain embodiments, lower rollers are provided along the side portions of the frame that have an axis of rotation perpendicular to the top roller and permit rolling to continue even when the apparatus is tipped or tilted. Most preferably, the rolling restraint device of the present invention is adapted to engage a railway rail.

The present invention also discloses methods of tethering a person to a railway rail comprising the steps of opening a hinged rolling restraint device and engaging the restraint device on the rail. The restraint device is then locked to the rail and a tether is engaged to a restraint point disposed on the restraint device. The tether is then attached to the person and the restraint device rolls along the rail as the person moves relative to the rail. In the event of a mishap the connection point on the rail and the tether would safely suspend a person from the rail and permit rescue.

DETAILED DESCRIPTION OF THE PREFERRED EMBODIMENTS

Figure 1:
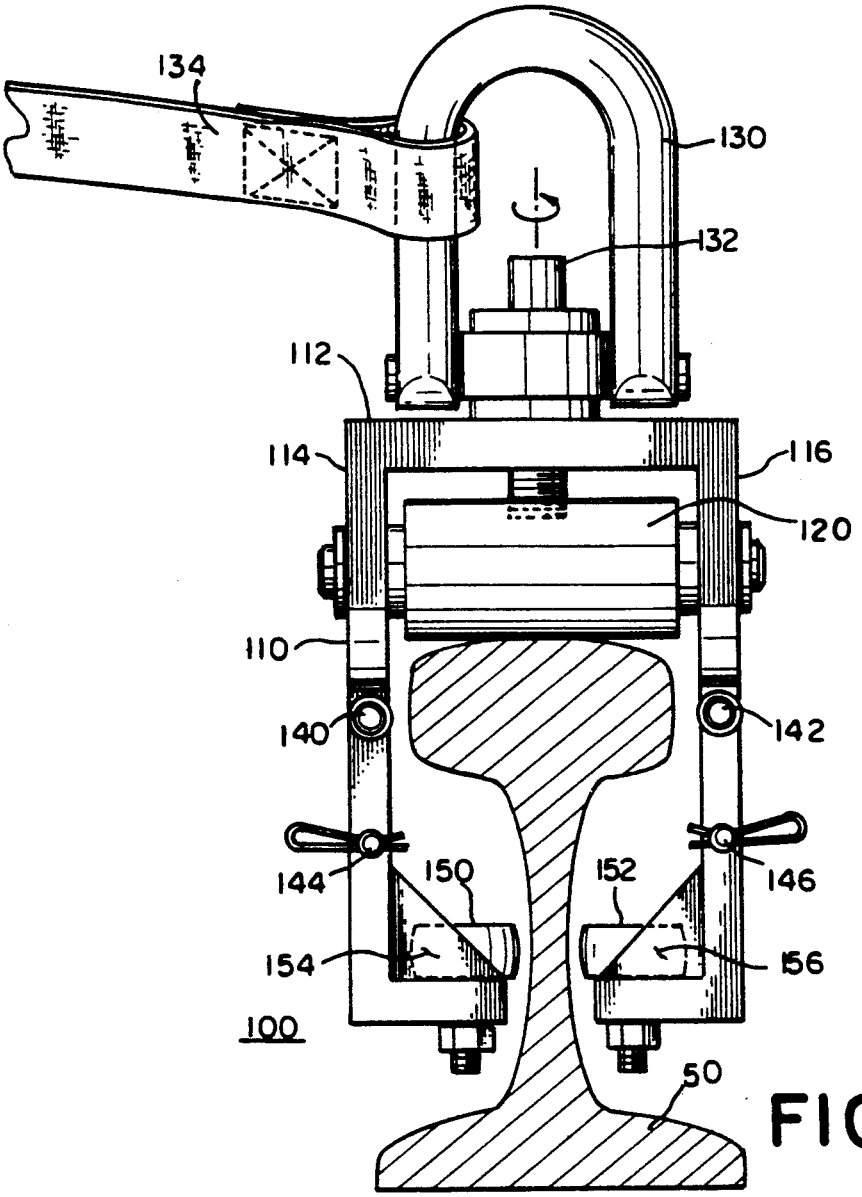
FIG. 1 is a front elevation view of a rolling restraint made in accordance with the present invention.

Referring now to FIG. 1, there is shown a front elevation view of a rolling restraint device 100 made in accordance with the present invention. As shown, the rolling restraint device 100 is most preferably adapted to engage a railway rail 50. However, those of ordinary skill will realize that the advantages of the present invention can also be realized when the rolling restraint device is engaged with other structural elements 50 such as I-beams, channels, pipes and other structural shapes. Moreover, although the present invention is shown in a vertical orientation, it will be understood that with slight modification, the device 100 could be configured horizontally, at an angle, or even to operate in an inverted position.

Figure 2:
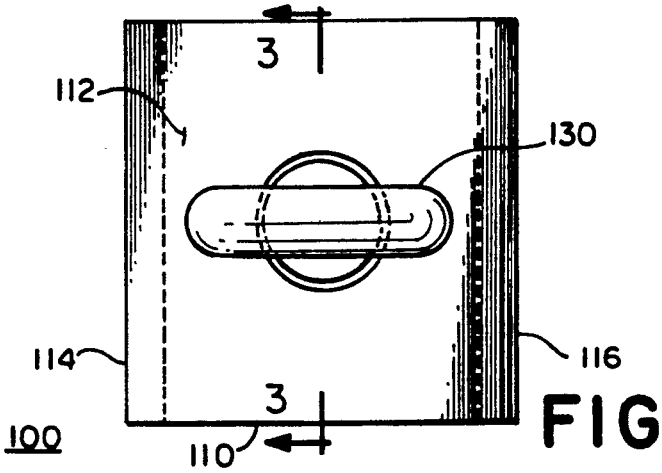
FIG. 2 is a top plan view of the rolling restraint device of FIG. 1.

In a preferred embodiment illustrated in FIG. 1, the rolling restraint device 100 comprises a frame 110 comprised of top portion 112 and side portions 114,116. Within the frame 110 is at least one roller 120 disposed so as to engage and roll along the top surface of the rail 50. The details of the construction of the rollers 120 and the associated axles, hardware, bearings and the like are well known to those of ordinary skill. A restraint point 130 is preferably disposed immediately above the roller 120. In a preferred embodiment, the restraint point 130 comprises a pivotable ring as shown in FIG. 1 that is connected to the upper portion of the frame 112 at an axis of rotation 132. The pivotable ring 130 permits the attached tether 134 to remain aligned with the person as they move about relative to the restraint device 100 such that binding and twisting of the tether is minimized. As shown in FIG. 2, the restraint point 130 is most preferably centered on the top surface 112 of the frame 110. Those of ordinary skill will realize that although the tether 134 is illustrated as being a sewn webbing-type strap, numerous types of hardware connections including hooks, D-rings, snap rings and the like can be provided to allow the tether to be attached and detached while providing a sufficiently strong and secure connection. Moreover, it is also understood that the tether 134 itself may comprise a web strap, a chain, cable or combinations of such materials.

Referring again to FIG. 1, it can also be seen that in a preferred embodiment of the rolling restraint device 100 of the present invention at least one and most preferably both of the side sections 114,116 are hinged using hinge pins 140,142 that permit them to be moved out of engagement with the rail 50 or other structure. As explained in further detail below, once the rolling restraint device 100 is installed on a rail 50, locking pins 144,146 prevent the hinge pins 140,142 from operating and thereby prevent inadvertent disengagement. This hinged feature of the present invention permits the restraint device 100 to be easily engaged and disengaged yet provides a rugged design that meets all safety criteria.

Also visible in FIG. 1 are the lower rollers 150,152 provided in a most preferred embodiment of the present invention. The lower rollers 150,152 are positioned so that if the restraint device 100 is tipped to either side, the roller surface contacts the web of the rail 50 and permits the restraint device 100 to continue to roll. This prevents binding while the rolling restraint device 100 is being moved by pulling on the tether 134. Additionally, the side portions 114,116 of the frame 110 that carry the lower rollers 150,152 are reinforced, preferably using gussets 154,156 whereby in the event of a mishap, the structure surrounding the lower rollers 150,152 is sufficient to withstand the forces transferred at the point of contact with the rail 50.

Figure 3:
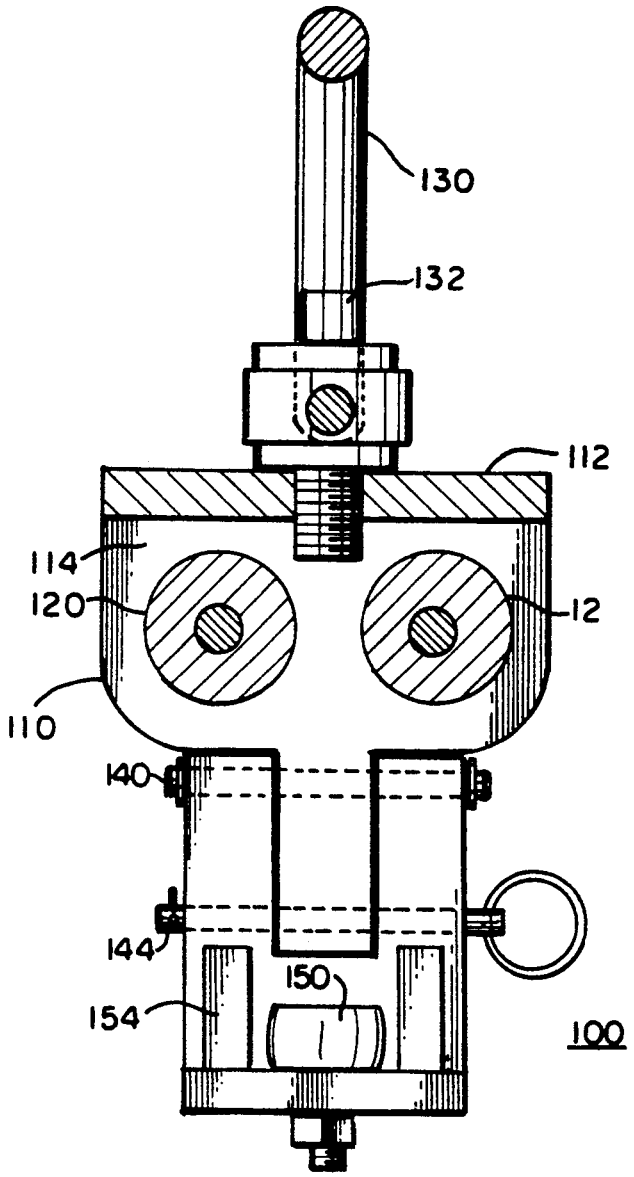
FIG. 3 is a cross-sectional side elevation view taken along line 3—3 in FIG. 2.

Additional details of the rolling restraint device 100 of the present invention can be seen in the cross-sectional side elevation view depicted in FIG. 3. As shown, in a most preferred embodiment, two rollers 120, 121 are used to contact the top surface of the rail 50 (not illustrated in this view). Also, in the preferred embodiment illustrated, the preferred arrangement of the side portions 114,116 can be seen. For purposes of illustration, the right side portion 116 has been removed from FIG. 3, thus, although the following discussion refers only to the left side portion 114, the descriptions apply equally to both side portions 114,116. However, it should be remembered that in certain embodiments, either of the side portions 114,116 can either be hinged in a different manner from the other or not hinged at all.

In the preferred embodiment shown in FIG. 3, the left side portion 114 is comprised of an upper left side portion 214 and a lower left side portion 215. The upper and lower side portions 214,215 are arranged to permit both the hinge pin 140 and the locking pin 144 to pass through both of them and perform their respective functions. However, other types of hinges and locks could be incorporated into these structures or attached thereto.

Although certain embodiments of the present invention have been set forth and described above with particularity, upon review of this disclosure, those of ordinary skill will realize that numerous modifications, variations and adaptations of the present invention are possible without departing from the spirit of the invention disclosed. Accordingly, reference should be made to the appended claims in order to determine the full scope of the present invention.

What is claimed is:

1. Apparatus for providing a rolling restraint point connected to a structure, the apparatus comprising:

a frame, comprising a top portion and two side portions for engaging the structure, at least one of the side portions comprising a hinge and a hinge lock;

at least one top roller disposed beneath the top portion of the frame having an axis of rotation parallel to a surface of the structure, the hinge and the hinge lock being located beneath the top roller; and a restraint point for connecting a tether disposed on the top portion of the frame.

2. The apparatus of claim 1, wherein at least one of the side portions is comprised of an upper portion and a lower portion and the hinge and hinge lock comprise a hinge pin and a hinge lock pin that engage each of the upper and lower portions.

3. The apparatus of claim 2 wherein the hinge pin is disposed above the hinge lock pin.

4. The apparatus of claim 1, further comprising two lower rollers disposed on the side portions of the frame, wherein the axis of rotation of the lower rollers is substantially perpendicular to the axis of the top roller.

5. The apparatus of claim 4 further comprising gussets disposed adjacent the lower rollers.

6. The apparatus of claim 1 further comprising a second top roller.

7. The apparatus of claim 6 wherein the first and second top rollers are aligned to have parallel and adjacent axes of rotation.

8. The apparatus of claim 1 wherein both of the side portions comprise a hinge and a hinge lock.

9. The apparatus of claim 1 wherein the restraint point comprises a pivotable ring.

10. The apparatus of claim 9 wherein the axis of the pivotable ring is disposed perpendicular to the top surface of the frame.

11. Rolling restraint apparatus for engaging a railway rail comprising:

a frame having a top portion and two side portions, at least one of the side portions comprising a hinge;

at least one roller for engaging the top surface of the railway rail disposed beneath the top portion of the frame, the hinge being located beneath the roller; and a restraint point disposed on the top portion of the frame.

12. The device of claim 11 wherein both of the side portions comprise a hinge.

13. The device of claim 11 further comprising lower rollers disposed on both of the side portions of the frame for engaging the web of the railway rail.

14. The apparatus of claim 11 wherein the restraint point comprises a pivotable ring.

15. The apparatus of claim 11 further comprises a second roller for engaging the top surface of the railway rail.

* * * * *